US005985806A

United States Patent [19]

O'Lenick, Jr.

[11] Patent Number: 5,985,806

[45] Date of Patent: Nov. 16, 1999

[54] TELOMERIZED COMPLEX ESTER TRIGLYCERIDES

[75] Inventor: Anthony J. O'Lenick, Jr., Dacula, Ga.

[73] Assignee: Lambent Technologies Inc, Norcross, Ga.

[21] Appl. No.: 09/233,224

[22] Filed: Jan. 19, 1999

[51] Int. Cl.[6] ..... C10M 129/68; C10M 129/74

[52] U.S. Cl. ..... 508/485; 508/491; 560/116; 560/127

[58] Field of Search ..... 508/485, 491; 560/127, 116; 554/22, 163

[56] References Cited

U.S. PATENT DOCUMENTS

| | | | |
|---|---|---|---|
| 2,483,791 | 10/1949 | Teeter et al. | 560/127 |
| 3,449,467 | 6/1969 | Wynstra | 560/127 |
| 3,455,802 | 7/1969 | D'Alelio | 560/127 |
| 5,229,023 | 7/1993 | Landis | 508/465 |
| 5,731,450 | 3/1998 | Alexander et al. | 560/127 |
| 5,783,528 | 7/1998 | Rondenberg | 508/485 |

FOREIGN PATENT DOCUMENTS 2063909 10/1981 United Kingdom .

*Primary Examiner*—Margaret Medley

[57] ABSTRACT

The present invention discloses a group of lubricant additives that have improved oxidative stability, high viscosity and relatively lower cost and that comprise the reaction product of a complex oleate ester telomerized with vegetable oils containing at least one linoleyl moiety of the three groups in the triglyceride. The resulting product is a high molecular weight liquid telomerized complex ester triglyceride having a plurality of branch groups. These groups render the compounds outstanding, highly oxidatively stable lubricants.

15 Claims, No Drawings

TELOMERIZED COMPLEX ESTER TRIGLYCERIDES

TECHNICAL FIELD OF THE INVENTION

The present invention relates to a unique composition of matter and it's use in lubricant compositions. More specifically, this invention relates to the reaction product of certain triglycerides having a at least one of the three alkyl groups in the triglyceride containing a conjugated double bonds with complex esters containing one double bond to make a whole new class of telomerized complex ester triglyceride products. The vegetable oil used as a reactant in the compounds of the present invention has at least one conjugated double bond, most commonly linoleyl group present. This type of group is referred to as a conjugated diene. These materials react with compounds having one double bond, like oleyl species, which are referred to as dienophiles. The reaction is a Diels Alder reaction. The resultant species is a six membered ring with the loss of two of the three double bonds. A heretofore-unknown class of telomerized complex ester triglyceride results.

Linoleic acid has two double bonds that are reactive in the telomerization reaction. The structure is as follows:

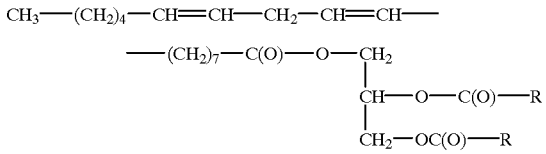

The "R" groups can be linoleyl, which would make all three groups reactive or non-conjugated which would make the oil monoreactive. In instances where there is more than one linoleyl group, crosslinked polymers result.

The oleic species has one double bond, but there are several of them in the complex ester. Pentaerythritol tetra oleate is an example of such a product.

When the reactive diene (linoleyl group) and oleyl group (dienophile group) are present in equimolar amounts the reaction occurs. The double bonds re-arrange making a six membered ring having one double bonds. The number of double bonds is reduced by ⅔.

The present invention further relates to methods for using a telomerized oil as lubricants and personal care oil phases, specifically Jojoba replacements.

It should be clearly understood that the term vegetable oil as used herein refers to a compound that is a triglyceride, that is three acyl groups esterified onto glycerin.

BACKGROUND OF THE INVENTION

Lubricants are widely used to reduce friction between surfaces of moving parts and thereby reduce wear and prevent damage to the surfaces and parts. Lubricants are composed principally of a base stock and a lubricant additive. The base stock is generally a relatively high molecular weight hydrocarbon. In applications where there is a large amount of pressure applied to moving parts, lubricating compositions composed only of hydrocarbon base stock tend to fail and the parts become damaged.

This problem has been addressed by adding materials (i.e., lubricant additives) to the lubricating composition to increase high-pressure performance. Such additives are called "extreme pressure additives." Examples of extreme pressure additives are sulfuirized sperm whale oil and sulfurized jojoba oil. There is a continuing need in the art to find alternate extreme pressure additives because sperm whale oil is no longer available due to an international ban and jojoba oil is expensive and in short supply.

Extreme pressure additives prevent destructive metal-to-metal contact in lubrication at high pressure and/or temperature such as that found in certain gear elements in automotive vehicles and various industrial machines where high pressure can cause a film of lubricant to rupture. Extreme pressure/anti-wear lubricants should have good lubricity, good cooling properties, high film strength, good load bearing ability, and miscibility with the usual types of base oils.

To make lubricants, such as motor oils, transmission fluids, gear oils, industrial lubricating oils, metal working oils, etc., one starts with a lubricant grade of petroleum oil from a refinery, or a suitable polymerized petrochemical fluid. Into this "base stock" is blended small amounts of specialty chemicals that enhance lubricity, inhibit wear and corrosion of metals, and retard damage to the fluid from heat and oxidation.

Anti-wear agents, extreme pressure agents and friction modifiers have been developed that are generally organic or organometallic compounds containing halogens, sulfur, phosphorus, or a combination of the three. Halogens have noted low-temperature metal-coating activity but can cause serious corrosion problems at the higher operating temperatures of modern vehicles or industrial machinery and have environmental problems upon disposal. Manufactures have, therefore, switched to derivatives of sulfur and phosphorus for lubricant additives.

Before 1972, lubricant additives were based on raw and chemical derivatives of sperm whale oil, a monoester of monounsaturated fatty acid chains. Replacement additives include phosphorized lard oils, sulfurized polyisobutylene and moderate molecular weight polymers. These additives have met with limited success. Better lubricating properties (i.e., friction and reduced wear) have been achieved with a natural wax ester, such as jojoba oil. Lubricant additives using, jojoba oil have been described in U.S. Pat. No. 4,873,008, the disclosure of which is incorporated by reference herein. Jojoba oil suffers from limited availability and high cost.

Synthetic wax esters can be made by esterifying an unsaturated fatty acid and an unsaturated fatty alcohol. Synthetic wax ester can be sulfurized. Sulfurized wax esters often display excellent lubricating properties. However, the cost of a process to create and isolate a synthetic wax ester is extremely high and comparable with the cost of natural wax ester.

One solution to this problem is described in U.S. Pat. No. 4,970,010, the disclosure of which is incorporated by reference herein. This patent describes a group of sulfurized derivatives of triglyceride vegetable oil that achieve acceptable lubricating properties. However, processing costs are still relatively high because this process requires the presence of at least 25% wax ester and preferably, 50% wax ester. For practical applications, synthetic wax esters have to be derived from natural vegetable triglycerides, such as rapeseed oil or corn oil. Cost-adding conversion steps to a synthetic wax ester make synthetic wax esters relatively uneconomical for use as lubricant additives.

Liquid wax esters are formed by forming an ester bond between the functional groups of an unsaturated fatty acid and an unsaturated fatty alcohol. Liquid wax esters have been made from triglyceride rapeseed oil, such as a high erucic acid rapeseed (HEAR) oil by a complex and expensive process, such as is described in Bell, U.S. Pat. No. 4,152,278. HEAR oil is a triglyceride in its native form. Synthetic wax ester made from HEAR oil is a substitute for sperm whale oil or a natural wax ester, such as jojoba oil.

Synthetic wax esters can be made into phosphorous or sulfurized derivatives to improve friction, wear and extreme-pressure properties of a fluid. For example, sulfurized vegetable oil wax esters are described in U.S. Pat. No. 4,152,278 and phosphite adducts of synthetic vegetable oil wax esters are described in U.S. Pat. No. 4,970,010.

Although the supply of HEAR is more stable than the supply and availability of jojoba oil, the process of transforming a triglyceride oil into a mono-ester form is a difficult and expensive process with little, if any, cost advantage over jojoba oil. Thus, there is a need in the art to be able to use a vegetable triglyceride oil directly as a lubricant additive or as a derivative to eliminate the expensive conversion steps into a synthetic wax ester and retain the advantage of low cost and availability.

Triglyceride vegetable oils, such as HEAR, contain 10%–25% polyunsaturated fatty acids and are rich in longer chain (20–24 carbon atom) fatty acids. Dienic (two double bonds) fatty acids and trienic (three double bonds) fatty acids in a triglyceride oil are more reactive than monoenic (single double bond) fatty acids. Double bonds in a vegetable oil triglyceride, when used directly in a high temperature oxidizing environment, such as a lubricant additive, are attacked by oxygen and heat which causes the triglyceride to darken, thicken and lose solubility within lubricating oil base stocks. These undesirable properties limit the usefulness of triglyceride vegetable oils for lubricant additives. Therefore, there is a further need in the art to find an inexpensive processing means to improve the lubricating properties and characteristics of triglyceride oils for use as lubricant additives. This invention was made to satisfy those needs.

SUMMARY OF THE INVENTION

The present invention relates to the telomerization of a triglyceride vegetable oil having a high concentration of a conjugated diene, with a complex ester having multiple single double bonds. This results in a novel telomerized complex ester triglyceride. The invention further relates to the use of these telomerized triglyceride products as a lubricating composition base stock substitute.

The telomerized complex ester triglyceride products are produced by a process comprising heating a diene triglyceride vegetable oil conforming to the following structure:

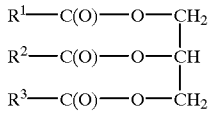

wherein:

$R^1$ is $$CH_3—(CH_2)_5—CH=CH—CH_2—CH=CH—(CH_2)_6—$$

$R^2$ and $R^3$ are selected from the group consisting of $$CH_3—(CH_2)_5—CH=CH—CH_2—CH=CH—(CH_2)_6—(\text{linoleyl}),$$

or alkyl having from 12 to 20 carbon atoms;

with a complex ester conforming to the following structure:

$$(CH_3)_x—C—(CH_2O—C(O)—R)_y$$

x is an integer ranging between 0 and 3;

y is an integer ranging between 1 and 4 with the proviso that x+y=4;

R is oleyl conforming to the following structure $CH_3—(CH_2)_7—CH=CH—(CH_2)_7—$.

The reaction is as follows:

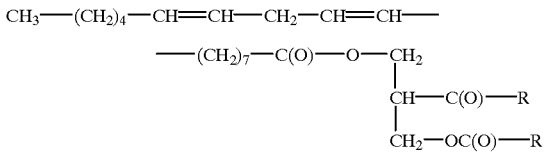

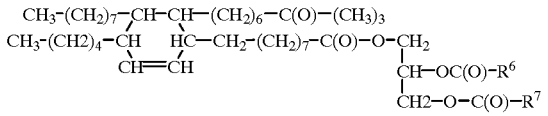

The reaction is conducted in a non-oxidizing atmosphere for at least 5 hours at a temperature of from about 200.degree. C. to about 400.degree. C. Traces of water in the form of water vapor facilitate the telomerization process and act as a catalyst for the telomerization reaction The compounds of the present invention conform to the following structure:

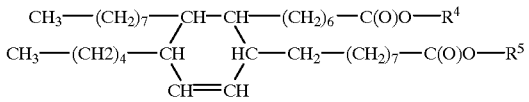

$R^5$ is

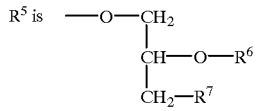

$R^6$ and $R^7$ are selected from the group consisting of

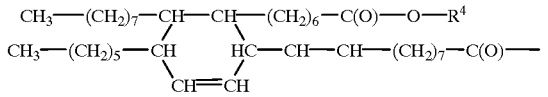

or alkyl having from 12 to 20 carbon atoms.

$R^4$ is $(CH_3)_x—C—(CH_2O—C(O)—)_y$

DETAILED DESCRIPTION OF THE INVENTION

The present invention relates to the discovery that vegetable oil containing at least one linoleyl moiety can be reacted with a complex ester having a single double bond making a unique lubricating telomerized complex ester triglyceride that has an aliphatic ring that can used in lubricant additives and lubricating compositions. The advantage of these telomerized products is that they are relatively inexpensive, very highly molecular weight (hence low volatility), highly branched (hence liquid to low temperature), and very stable to oxidation.

The present invention also relates to a telomerized complex ester triglyceride prepared by reacting a linoleyl containing vegetable oil, with an oleyl complex ester to produce a novel telomeric ester. The process comprises heating the vegetable oil conforming to the following structure:

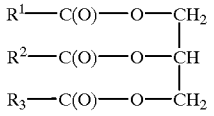

wherein:

$R^1$ is $CH_3—(CH_2)_4—CH=CH—CH_2—CH=CH—(CH_2)_7—$ $R^2$ and $R^3$ are selected from the group consisting of $CH_3—(CH_2)_4—CH=CH—CH_2—CH=CH—(CH_2)_7—$ or alkyl ranging from C12 to C20;

with a complex ester conforming to the following structure:

$$(CH_3)_x—C—(CH_2O—C(O)—R)_y$$

x is an integer ranging between 0 and 3;

y is an integer ranging between 1 and 4 with the proviso that x+y=4;

R is oleyl conforming to the following structure $CH_3—(CH_2)_7—CH=CH—(CH_2)_7—$;

to a temperature of 200.degree. C. to 400.degree. C. in a non-oxidizing atmosphere and in the presence of a catalyst, periodically measuring viscosity of the oil over time as a measure of the telomerization reaction. The telomerization reaction is completed, by one measure, when the rate of viscosity increase over time decreases and remains constant.

The present invention further relates to a method for improving the viscosity of a lubricant additive comprising adding a telomerized complex ester triglyceride or a sulfurized or phosphorous derivative thereof in place of a triglyceride vegetable oil or wax ester thereof. Telomerized complex ester triglyceride have the surprising property of increasing viscosity as compared with triglyceride vegetable oils or wax esters when used as part of a lubricant additive composition or a lubricating composition.

EXAMPLES

Triglycerides

Preferred vegetable oils include, those with greater than 33% linoleyl moiety (C18:2). Typical oils include Example 1–9.

The nomenclature for the carbon distribution is as follows

| | | |
|---|---|---|
| C-16 | means | C16 saturated acid |
| C-18 | means | C18 saturated acid |
| C-18:1 | means | C18 one unsaturation (oleyl) |
| C-18:2 | means | C18 two unsaturation (linoleyl) |
| C-18:3 | means | C18 three unsaturation (linoleic) |

Example 1

Soybean oil

Soybean oil is a triglyceride derived from the soybean (*Glycerin max* L).

Carbon Distribution

| Component | Typical % Weight | |
|---|---|---|
| C-16 | 7 | CAS Number: 8001-22-7 |
| C-18 | 4 | EINECS Number: 232-274-4 |
| C-18:1 | 29 | |
| C-18:2 | 54 | Iodine Value: 130 |
| C-18:3 | 5 | |

Example 2

Corn Oil

Corn oil is a triglyceride derived from the wet milling of corn (*Zea mais*, Graminae).

Carbon Distribution

| Component | Typical % Weight | |
|---|---|---|
| C-16 | 8 | CAS Number: 8001-30-7 |
| C-18 | 4 | EINECS Number: 232-281-2 |
| C-18:1 | 46 | Iodine Value: 123 |
| C-18:2 | 42 | |

Example 3

Sunflower Seed Oil

Sunflower seed oil is a triglyceride derived from the seeds of the sunflower (*Helianthus annus* L.).

Carbon Distribution

| Component | Typical % Weight | |
|---|---|---|
| C-16 | 6 | CAS Number: 8001-21-6 |
| C-18 | 5 | EINECS Number: 232-273-9 |
| C-18:1 | 20 | |
| C-18:2 | 68 | Iodine Value: 130 |

Example 4

Safflower Oil

Safflower oil is a triglyceride derived from the species *Carthamus Tinctorius*.

Carbon Distribution

| Component | Typical % Weight | |
|---|---|---|
| C-16 | 6 | CAS Number: 8001-23-9 |
| C-18 | 3 | EINECS Number: 232-276-6 |
| C-18:1 | 18 | |
| C-18:2 | 73 | Iodine Value: 145 |

Example 5

Poppy Seed Oil

Poppy seed oil is a triglyceride derived from the poppy (*Papaver orientiale*)

Carbon Distribution

| Component | Typical % Weight | |
|---|---|---|
| C-16 | 10 | CAS Number: 8002-11-7 |
| C-18 | 2 | EINECS Number: |
| C-18:1 | 15 | |
| C-18:2 | 73 | Iodine Value: 138 |

Example 6

Walnut Oil

Walnut oil is a triglyceride derived from the walnut (*Juglans regia*).

Carbon Distribution

| Component | Typical % Weight | |
|---|---|---|
| C-16 | 6 | CAS Number: 8024-09-7 |
| C-18 | 4 | |
| C-18:1 | 26 | EINECS Number: 84604-00-2 |
| C-18:2 | 48 | |
| C-18:3 | 16 | Iodine Value 150 |

Example 7

Sesame Oil

Sesame oil is a triglyceride, which is derived from *Sesamun indicum*.

Carbon Distribution

| Component | Typical % Weight | |
|---|---|---|
| C-16 | 8 | CAS Number: 8008-74-0 |
| C-18 | 5 | EINECS Number: 232-370-6 |
| C-18:1 | 47 | |
| C-18:2 | 40 | Iodine Value: 110 |

Example 8

Cottonseed Oil

Cottonseed is a triglyceride derived from cotton (*Gossypium hirsutum*).

Carbon Distribution

| Component | Typical % Weight | |
|---|---|---|
| C-14 | 1 | CAS Number: 8001-29-4 |
| C-16 | 21 | EINECS Number 232-280-7 |
| C-18 | 2 | Titer Point |
| C-18:1 | 32 | Iodine Value: 108 |
| C-18:2 | 44 | |

Example 9

Wheat Germ Oil

Wheat germ oil is a triglyceride derived from the extraction of wheat germ.

Carbon Distribution

| Component | Typical % Weight | |
|---|---|---|
| C-16 | 15 | CAS Number: 8006-95-9 |
| C-18 | 3 | EINECS Number: N/A |
| C-18:1 | 20 | |
| C-18:2 | 55 | Iodine Value: 120–140 |
| C-18:3 | 7 | |

Complex Esters

The complex esters of the present invention are the oleic acid esters of polyols. These esters are items of commerce available from Lambent Technologies Inc. Norcross, Ga.

They conform to the following structure:

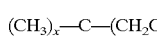

$$(CH_3)_x—C—(CH_2O—C(O)—R)_y$$

x is an integer ranging between 0 and 3;

y is an integer ranging between 1 and 4 with the proviso that x+y=4;

R is oleyl conforming to the following structure $CH_3—(CH_2)—CH=CH—(CH_2)—$;

Example 10

Pentaerythitol Tetraoleate (x is 0, y is 4)

This compound conforms to the following structure:

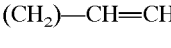

$$C—(CH_2—O—C(O)—R)_4$$

R is oleyl.

Example 11

Trimethyol Propane Trioleate (x is 1, y is 3)

This compound conforms to the following structure:

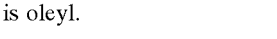

$$CH_3—C—(CH_2—O—C(O)—R)_3$$

R is oleyl.

Example 12

Neopentylglycol Dioleate (x is 2, y is 2)

This compound conforms to the following structure:

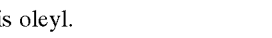

$$(CH_3)_2C—(CH_2—O—C(O)—R)_2$$

R is oleyl.

Reaction Sequence

The telomerization process is conducted in a non-oxidizing atmosphere. Preferably it is conducted with a minimum amount of oxygen present, and most preferably under a nitrogen blanket. Other reducing atmospheres can be used, such as the inert gases helium, neon, argon and combinations thereof.

Preferably, a catalyst at a concentration from about 0.5% to about 5.0% by weight, is added to the triglyceride vegetable oil for the telomerization reaction. The catalyst is a cationic catalyst, anionic catalyst, solid strong acid catalyst or a combination thereof. Examples of cationic catalysts include ester-complexed chloride, phenol-complexed boron trifluoride and dibutyl tin dichloride. Anionic catalysts include, for example, butyl-lithium, butyl potassium, and metallic sodium. Examples of solid acid catalysts include Zeolites and resin sulfonic acid.

Preferably, a reaction initiator may be added to the vegetable oil to start the telomerization process. An example of a reaction initiator is a peroxide, such as di-t-butyl-peroxide or air, at concentrations ranging from about 1.0% to about 10% by weight.

The reaction is conducted in a non-oxidizing atmosphere for at least 5 hours at a temperature of from about 200.degree. C. to about 400.degree. C. Traces of water in the form of water vapor facilitate the telomerization process and act as a catalyst for the telomerization reaction General Procedure To a suitable reaction flask is added the specified amount of the specified oil and the specified amount of the specified complex ester. Nitrogen is then applied to the mixture. Next, 1.0% by weight of dibutyl tin dichloride is then added (% based upon the weight of the oil and complex ester), followed by 1.0% of di-t-butyl-peroxide added (% based upon the weight of the oil and complex ester). The mixture is heated to 300° C. and held at this temperature 7 hours.

Example 13

To a suitable reaction flask is added the 400.0 grams of the oil Example 1 and 100.0 grams of complex ester Example 10. Nitrogen is then applied to the mixture. Next, 1.0% by weight of dibutyl tin dichloride is then added (% based upon the weight of the oil and complex ester), followed by 1.0% of di-t-butyl-peroxide added (% based upon the weight of the oil and complex ester). The mixture is heated to 300° C. and held at this temperature 7 hours.

Examples 14–39

Example 13 is repeated only this time the specified amount of the specified oil is added to the 100.0 grams of the specified complex ester.

| | Oil | | Complex Ester |
|---|---|---|---|
| Example | Example | Grams | Example |
| 14 | 2 | 285.0 | 10 |
| 15 | 4 | 181.0 | 10 |
| 16 | 5 | 181.0 | 10 |
| 17 | 6 | 115.0 | 10 |
| 18 | 7 | 1428.0 | 10 |
| 19 | 8 | 833.0 | 10 |
| 20 | 9 | 285.0 | 10 |
| 21 | 1 | 400.0 | 11 |
| 22 | 2 | 285.0 | 11 |
| 23 | 3 | 208.0 | 11 |
| 24 | 4 | 181.0 | 11 |
| 25 | 5 | 181.0 | 11 |
| 26 | 6 | 115.0 | 11 |
| 27 | 7 | 1428.0 | 11 |
| 28 | 8 | 833.0 | 11 |
| 29 | 9 | 285.0 | 11 |
| 31 | 1 | 400.0 | 12 |
| 32 | 2 | 285.0 | 12 |
| 33 | 3 | 208.0 | 12 |
| 34 | 4 | 181.0 | 12 |
| 35 | 5 | 181.0 | 12 |
| 36 | 6 | 115.0 | 12 |
| 37 | 7 | 1428.0 | 12 |
| 38 | 8 | 833.0 | 12 |
| 39 | 9 | 285.0 | 12 |

Analysis

During the telomerization reaction, iodine number decreases and viscosity increases nearly with time. Either or both assays are appropriate for measuring telomerization.

The telomers esters are soluble in organic solvents and in hydrocarbon oils and esters. Progressive decrease in iodine number with time is a measure of the extent of telomerization. Similar monitoring of the telomerization reaction can be made by measuring increasing viscosity or increasing molecular weight as a measure of polymerization. The iodine number decreases because the number of carbon—carbon double bonds decrease with formation of aliphatic rings and, particularly cyclohexane rings between fatty acid groups. Most telomerization reactions are completed by 30 hours at 300.degree. C. Similarly, viscosity increases as the degree of polymerization increases through formation of aliphatic rings.

Properties

Telomerized complex ester triglyceride possess increased oxidation resistance. Increased oxidation resistance, or oxidative stability, results from polymerization of the vegetable oils and complex ester. There are fewer carbon-carbon double bonds in telomerized vegetable oil subject to attack by oxygen.

What is claimed:

1. A telomerized complex ester triglyceride produced by the telomerization reaction of a diene conforming to the following structure:

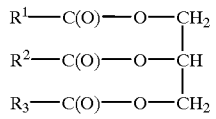

wherein:

$R^1$ is $$CH_3—(CH_2)_4—CH=CH—CH_2—CH=CH—(CH_2)_6—$$

$R^2$ and $R^3$ are selected from the group consisting of $$CH_3—(CH_2)_4—CH=CH—CH_2—CH=CH—(CH_2)_6—,$$

or alkyl having from 12 to 20 carbon atoms;

with a complex ester conforming to the following structure:

$$(CH_3)_x—C—(CH_2O—C(O)—R)_y$$

x is an integer ranging between 0 and 3;

y is an integer ranging between 1 and 4 with the proviso that x+y=4;

R is oleyl conforming to the following structure $$CH_3—(CH_2)_7—CH=CH—(CH_2)_7—;$$

said telomerization reaction conducted in a non-oxidizing atmosphere for at least 5 hours at a temperature of from about 200° C. to about 400° C. in the presence of a catalyst.

2. A telomerized complex ester triglyceride of claim 1, wherein x is 1, y is 3.

3. A telomerized complex ester triglyceride of claim 1, wherein x is 2, y is 2.

4. A telomerized complex ester triglyceride of claim 1, wherein x is 0, y is 4.

5. A telomerized complex ester triglyceride produced by the reaction an vegetable oil containing at least one linoleyl moiety selected from the group consisting of soybean oil, corn oil, sunflower seed oil, safflower oil, walnut oil, cottonseed oil and wheat germ oil with a complex ester selected from the group consisting of pentaerythitol tetraoleate, trimethyol propane trioleate, and neopentylglycol dioleate, said telomerization reaction conducted in a non-oxidizing atmosphere for at least 5 hours at a temperature of from about 200° C. to about 400° C.

6. A telomerized complex ester triglyceride of claim 5 wherein said triglyceride is soybean oil.

7. A telomerized complex ester triglyceride of claim 5 wherein said triglyceride is corn oil.

8. A telomerized complex ester triglyceride of claim 5 wherein said triglyceride is sunflower seed oil.

9. A telomerized complex ester triglyceride of claim 5 wherein said triglyceride is safflower oil.

10. A telomerized complex ester triglyceride of claim 5 wherein said triglyceride is walnut.

11. A telomerized complex ester triglyceride of claim 5 wherein said triglyceride is cottonseed oil.

12. A telomerized complex ester triglyceride of claim 5 wherein said triglyceride is wheat germ oil.

13. A telomerized complex ester triglyceride of claim 5 wherein said complex ester is pentaerythitol teteaoleate.

14. A telomerized complex ester triglyceride of claim 5 wherein said complex ester is trimethyol propane trioleate.

15. A telomerized complex ester triglyceride of claim 5 wherein said complex ester is neopentylglycol dioleate.

* * * * *